US007874901B2

(12) United States Patent
Kirkpatrick

(10) Patent No.: US 7,874,901 B2
(45) Date of Patent: Jan. 25, 2011

(54) POKER GAME METHOD AND SYSTEM

(76) Inventor: David A. Kirkpatrick, 9924 Tamareck Landing, Las Vegas, NV (US) 89117

( * ) Notice: Subject to any disclaimer, the term of this patent is extended or adjusted under 35 U.S.C. 154(b) by 1479 days.

(21) Appl. No.: 11/146,197

(22) Filed: Jun. 7, 2005

(65) Prior Publication Data

US 2006/0281513 A1 Dec. 14, 2006

(51) Int. Cl.
*A63F 9/24* (2006.01)
*A63F 13/00* (2006.01)

(52) U.S. Cl. ..... 463/13; 463/1; 463/16; 463/20; 463/42

(58) Field of Classification Search ..... 463/1, 463/13, 20, 42, 16, 422
See application file for complete search history.

(56) References Cited

U.S. PATENT DOCUMENTS 5,294,120 A * 3/1994 Schultz ..... 463/13
5,374,067 A * 12/1994 Jones ..... 273/292
5,382,025 A * 1/1995 Sklansky et al. ..... 273/292
6,132,311 A * 10/2000 Williams ..... 463/13
6,227,969 B1 * 5/2001 Yoseloff ..... 463/13
6,749,500 B1 * 6/2004 Nelson et al. ..... 463/13
7,044,468 B2 * 5/2006 Sklansky et al. ..... 273/292
7,380,795 B2 * 6/2008 Novellie et al. ..... 273/292
2001/0038178 A1 * 11/2001 Vancura ..... 273/274
2004/0072608 A1 * 4/2004 Toyoda ..... 463/17
2004/0242297 A1 * 12/2004 Walker et al. ..... 463/13
2005/0164789 A1 * 7/2005 Nakamura et al. ..... 463/36
2006/0052148 A1 * 3/2006 Blair et al. ..... 463/13

OTHER PUBLICATIONS

Bochan, "How to Play Texas Hold 'em", www.about.com, retrieved from Internet URL:<http://poker.about.com/od/poker101/ht/holdem101.htm> on Jul. 2, 2009.*
Bochan, "Antes and Blinds", www.about.com, retrieved from Internet URL:<http://poker.about.com/od/poker101/a/bettingbasics_2.htm> on Jul. 2, 2009.*
Bochan, "Betting Structures", www.about.com, retrieved from Internet URL:<http://poker.about.com/od/poker101/a/bettingbasics_4.htm> on Jul. 2, 2009.*

* cited by examiner

*Primary Examiner*—John M Hotaling, II
*Assistant Examiner*—Ryan Hsu
(74) *Attorney, Agent, or Firm*—Craig Weiss; Weiss & Moy, P.C.

(57) ABSTRACT

A method of playing a Texas Hold'em-type poker game where each player is individually rewarded by obtaining a five-card combination exceeding a predetermined amount. A system includes a display, game controls and a processor executing program instructions for providing a Hold'em type poker game for one or more players.

4 Claims, 2 Drawing Sheets

POKER GAME METHOD AND SYSTEM

BACKGROUND OF THE INVENTION

1. Field of the Invention

The present invention relates generally to card games, and more specifically, to a method and system for playing a Texas Hold'em-type poker game.

2. Background of the Invention

Poker has recently become a very popular pastime. One version, known as "Texas Hold'em" or just "Hold'em" is played by each player competing with each other to obtain the highest value five-card hand. Typically, play begins with one player designated as the dealer, and the two players to the immediate left of the dealer placing forced bets (the "blinds"). Each player is then dealt two cards. A first round of betting occurs, where each player decides whether to fold, call, or raise the bet of the prior player. Following the conclusion of the first betting round, three community cards are dealt known as the "flop." Following the flop, remaining players engage in a second round of betting. Next, a single community card known as the "turn" is dealt. Another round of betting follows the turn, and finally the fifth and final community card is dealt, known as the "river." A final round of betting follows the river. The player having the highest five-card poker hand formed from his or her two cards and the five community cards wins the "pot," which generally includes all bets placed during the game, minus a percentage for the establishment providing the game.

Hold'em is an exciting game in part because of the uncertainty of each player's final five-card hand until the river, when all seven available cards—the player's two and the five community cards—are known. Thus, even a player's relatively poor two cards—such as a 2-6— may result in a winning hand if, for example, the community cards reveal a 3, 4, and 5, providing the player with a straight. The player holding a losing hand but hoping that the final community cards will complete a winning hand undergoes excitement and suspense as the community cards are dealt. Furthermore, in order to complete a winning hand on the river, the player's resolve is repeatedly tested as other players having stronger hands place bets that must be called to remain in the game.

However, Hold'em has several drawbacks. One drawback is that the game often requires extended periods of inactivity. Because only two players are forced to bet in any hand (the blinds), the other players are able to examine and discard their poor cards without incurring a loss. As a result, often a player will not participate in the game for long periods until two favorable cards are received. Casino patrons that prefer the action and immediate decision of other casino games frequently choose not to exercise the patience and devote the time required for proper Hold'em play.

Another drawback of Hold'em is that, unlike other casino games, each player plays against the others, and not against the house. In blackjack or pai gow poker, for example, it is possible for every player to win on one hand, and the expert or novice play of any of these players statistically does not affect the outcome of the game for the other players. However, in Hold'em only one player wins each hand, and that player's winnings comprises the other players' losses. Novice players are more likely to lose to skillful players, and therefore casual players are less likely to participate in the game at all.

A third drawback to Hold'em is that while a player may know the value of his own hand, he must deduce the value of other player's hands. Thus, each player must pay attention to the play of each other player, and attempt to decipher the body language and betting behavior of each opponent. Bluffing, slow playing, mind games, and all other forms of misdirection are used and must be guarded against. For a causal player desiring a game based primarily on a draw of the cards, the mental effort required for skillful play may make the game undesirable.

Let-it-ride poker is a casino-style card game where each player in the game places three equal bets. Each player receives three cards, and based on those cards decides whether to retain the first of the three bets or remove the bet. The dealer exposes a first of two community cards, and each player must decide whether to retain the second of the three bets or remove the bet. Finally, the dealer exposes the second community card, resulting in each player having a five-card hand of his three cards plus the two community cards. If the player does not have a pair of tens or better, all bets not removed by the player are lost. If the player achieves a pair of tens or better, each bet is paid according to a payout table, from a pair of tens paying even money up to a royal flush paying 1,000-1.

Let It Ride Poker allows quick play and reward of all participating players. The play of each player has no effect at all on any other player or the game itself, and indeed the player's available options are limited solely to whether or not to remove his first and second bet. Because each player wins or loses based entirely on the value of his own hand, there is no need to predict an opponent's hand or compute a likelihood of outdrawing an opponent. Finally, the player is provided with the ability to remove his bets based on a partial knowledge of his hand, so that a losing hand can lose a minimum amount but a winning hand can win a maximum amount.

However, Let It Ride has several drawbacks. The first and second bet are independent, so that a player may remove both bets, neither bet, the first but not the second, or the second but not the first. This reduces the suspense and excitement because each bet is essentially a separate game independent of the other bet. Another drawback is that a player does not face exciting decisions as in Hold'em—that of calling an opponent's bet with additional money or folding and surrendering all previous bets. Instead, the Let It Ride player is never faced with a decision to fold, and is allowed reduce the amount likely to be lost if his cards are unfavorable. Finally, Let It Ride is very simple, and optimal play strategy is straightforward and easy to learn, so that proper play can be mechanical and not intellectually challenging.

Therefore, it would be desirable to provide a poker game method and device that provides benefits of both Hold'em and Let It Ride with fewer drawbacks.

SUMMARY OF THE INVENTION

It is an object of the present invention to provide a poker game whose basic play mimics Hold'em but players do not compete against each other.

It is another object of the present invention to provide a poker game whose basic play mimics Hold'em but each player's hand wins or loses without comparison to another hand.

It is yet another object of the present invention to provide a system for providing a poker game resembling Hold'em but without requiring additional players.

The above objectives are achieved in a poker game method and system.

BRIEF DESCRIPTION OF THE PREFERRED EMBODIMENTS

In accordance with one embodiment of the present invention, a method of playing a Texas Hold'em-type poker game is disclosed. It includes the steps of requiring at least one wager from each player, and disqualifying any player failing to provide the at least one wager that is required. The method further includes dealing two cards to each player remaining in the poker game, dealing three community cards, exposing the three community cards to each player remaining in the poker game, dealing a fourth community card, exposing the fourth community card to each player remaining in the poker game, dealing a fifth community card, and exposing the fifth community card to each player remaining in the poker game. The method also includes determining for each player remaining in the poker game a highest poker value five-card combination of the two cards dealt to said player and the five community cards, and paying each player remaining in the poker game a monetary award based on a pre-determined payout schedule if the player having a highest poker value five-card combination being not less than a pre-determined poker hand value.

In accordance with another embodiment of the present invention, a system for providing a poker game is disclosed. It includes a memory for storing data and program instructions, a processor coupled to the memory for processing the program instructions, a display coupled to the processor for displaying an output, and a game control coupled to the processor for receiving an input. The program instructions include instructions for requiring at least one wager from a player of the poker game, where the wager that is required being at least one of a pre-flop wager, a flop wager, and a turn wager, receiving an input from the game control in response to the requiring, disqualifying any player not providing the wager that is required, displaying two cards on the display to a player remaining in said poker game, displaying three community cards on the display a player remaining in said poker game, displaying a fourth community card on the display to a player remaining in the poker game, and displaying a fifth community card on the display to a player remaining in the poker game. The program instructions also include instructions for determining for a player remaining in the poker game a highest value five-card combination of the two cards dealt to the player and the five community cards, and paying a player remaining in the poker game a monetary award based on a pre-determined payout schedule if the player has a highest poker value five-card combination being not less than a pre-determined poker hand value.

The foregoing and other objectives, features, and advantages of the invention will be apparent from the following, more particular, description of the preferred embodiment of the invention, as illustrated in the accompanying drawings.

DETAILED DESCRIPTION OF THE PREFERRED EMBODIMENTS

Figure 1:
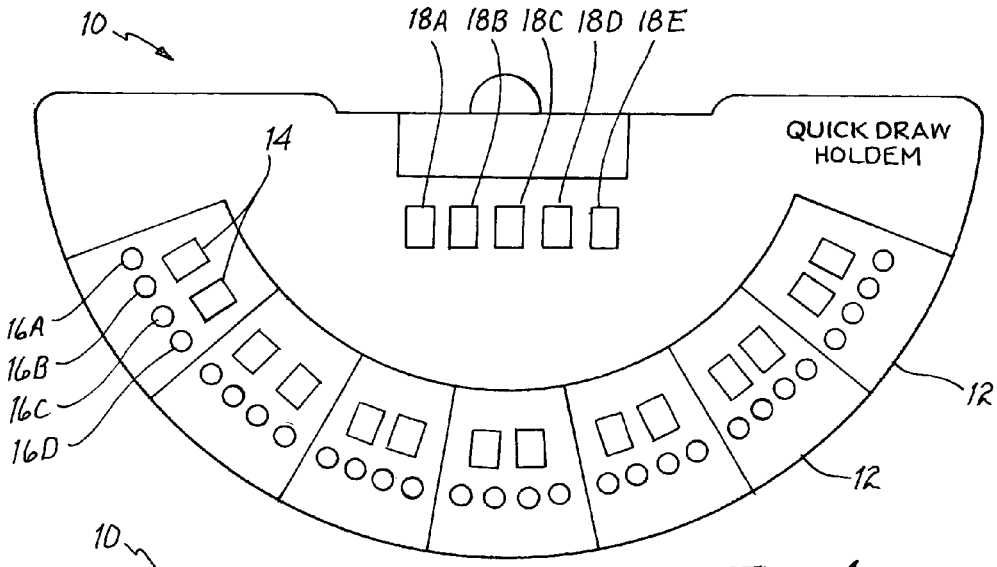
FIG. 1 is a top view of a card table for use with the poker game method of the present invention, showing positions for seven players, each player position having squares for the player's two cards and four betting circles, and a dealer position having squares for the five community cards, in accordance with an embodiment of the present invention.
Figure 1A:
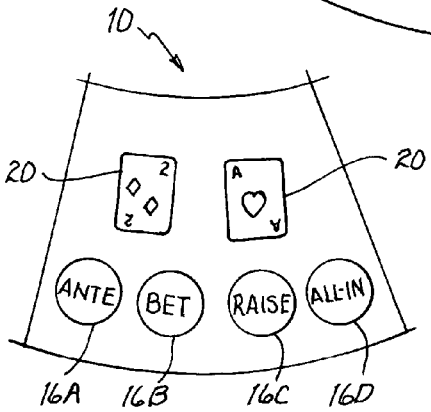
FIG. 1A is a top view of a single player position from the tale of FIG. 1, showing the player's two cards and detail of the four betting circles in accordance with an embodiment of the present invention.

Referring now to the figures and in particular to FIG. 1, a card table layout 10 is shown for the play of a poker game in accordance with embodiments of the present invention. Each player position 12 indicates two positions 14 for the player's individual cards 20 and four betting circles 16A-D for placing bets. Five positions 18A-E are provided for community cards 22.

The game begins with a first betting round in which each player is required to either place an ante wager or not participate in the game. The ante wager is a wager placed prior to a player's cards being exposed to the player. Each player from whom an ante wager is collected by placing an ante wager in the appropriate betting circle 14A is then dealt two cards, and each card is exposed to the player. Although it is preferred that all player cards are dealt face-up, they may be instead dealt face down and exposed to the player by the player lifting the cards to view their values.

It should be clearly understood that while it is preferred that layout 10 is used and that designated player card positions 14, betting circles 16A-D and community card positions 22 are used, it is within the spirit and scope of the present invention that any or all of layout 10 not be used, so long as each player's bets and cards in play are distinguishable.

After each player remaining in the game views his two cards, a second betting round is preferably conducted where a pre-flop wager is preferably required from each player. A pre-flop wager is a wager that is made after the player receives his two cards but before the dealer exposes any community cards to the players. The flop is the first three community cards that are exposed to the players. Players providing a pre-flop wager place the wager in the appropriate betting circle 16B. Any player not providing a pre-flop wager is preferably disqualified. A player that is disqualified surrenders all prior wagers, in this case the ante wager, and is removed from the game, meaning that the player is prevented from participating in the remainder of the game, although the player may elect to remain at their position and participate in a later game.

Three community cards (the flop) are then dealt face up, and thus exposed to remaining players, in community card positions 22. A third betting round is preferably conducted where a flop wager is preferably required from each player remaining in the game. A flop wager is a wager made after exposing three community cards but prior to exposing a fourth community card. Players providing a flop wager place the wager in the appropriate betting circle 16C. Players not providing a flop wager are preferably disqualified.

A fourth community card (the turn) is then dealt face up, and thus exposed to the remaining players, in a vacant community card position 22. A fourth betting round is preferably conducted where a turn wager is preferably required from each player remaining in the game. A turn wager is a wager made after exposing four community cards but prior to exposing a fifth community card. Players providing a turn wager place the wager in the appropriate betting circle 16D. Players not providing a turn wager are preferably disqualified.

A fifth community card (the river) is then dealt face up, and thus exposed to the remaining players, in a vacant community card position 22. Each ante wager, pre-flop wager, flop wager, and turn wager that was placed by each player not remaining in the game is preferably collected and removed as a losing wager.

For each player remaining in the game, a highest value five-card combination of the two cards dealt to the player and the five community cards is determined. Each player remaining in the game is preferably paid a first amount corresponding to the ante wager in conformity with that player's highest value five-card combination being not less than a predetermined value. For example, if the predetermined value is a pair of Kings and the player's highest five-card total is a pair of Aces or better, the player will be paid on his ante bet. Although it is preferred that the first amount that is paid be equal to the ante wager, the first amount may instead be any desired amount, and may be determined in proportion to the ante wager amount, to the player's five-card hand value, or both, or by any other desired method.

Similarly, each player remaining in the game is preferably paid a second amount corresponding to the player's pre-flop wager in conformity with that player's highest value five-card combination being not less than the predetermined value. Although it is preferred that the second amount that is paid be equal to the pre-flop wager, the second amount may instead be any desired amount, and may be determined in proportion to the pre-flop wager amount, to the player's five-card hand value, or both, or by any other desired method.

A third amount corresponding to each player's flop wager is also preferably paid to each player remaining in the game in conformity with that player's highest value five-card combination being not less than the predetermined value. Although it is preferred that the third amount that is paid be equal to the flop wager, the third amount may instead be any desired amount, and may be determined in proportion to the flop wager amount, to the player's five-card hand value, or both, or by any other desired method.

A fourth amount corresponding to the turn wager is preferably paid to each remaining player in conformity with a poker ranking of that player's highest value five-card combination. For example, a player's pair of Kings or Aces or two pair hand may be paid even money, three-of-a-kind paid 3-1, a straight paid 4-1, a flush paid 5-1, a full house paid 7-1, four-of-a-kind paid 15-1, a straight flush paid 30-1, and a royal flush paid 60-1. Of course, other pay schedules may be preferred, to ensure a favorable house percentage or to entice players with jackpot-type rewards.

If a player remaining in the game does not have a highest value five-card combination equaling or exceeding the predetermined value, each of the player's ante wager, pre-flop wager, flop wager, and turn wager are preferably collected as losing bets. For example, if the predetermined value is a pair of Kings or better, and a player has only a pair of sixes, that player loses all of his wagers.

An amount wagered for each of the ante, pre-flop, flop, and turn wagers should preferably be strictly controlled to prevent a player from wagering minimal amounts such as $1 for the ante, pre-flop, and flop wagers, and after having acquired a winning five-card total prior to the turn wager, increasing his wager to several thousand dollars for the turn wager. An example of a simple betting restriction is requiring the ante bet to be within a specified range, such as $5-$200, for example, and requiring each subsequent wager to equal the amount of the ante wager. Another example is to more closely mimic traditional Hold'em betting by requiring the ante wager to be within a specified range, such as $1-$100, and requiring each of the pre-flop wager and the flop wager to be an amount double the ante wager, and finally requiring the turn bet to be an amount double the pre-flop wager. As yet another example, a range may be allowed for each wager, such as requiring each subsequent wager amount to be between the amount of the prior wager and twice the amount of the prior wager. Any other desired method of determining allowable wagering amounts may instead be used without departing from the spirit and scope of the present invention.

It should be clearly understood that it is within the spirit and scope of the present invention that each of the ante wager, pre-flop wager, flop wager, and turn wager need not be required. Instead, any desired combination of the ante wager, pre-flop wager, flop wager, and turn wager may be required. For example, each player may only be required to place an ante wager and a turn wager. As another example, a player may only be required to place a pre-flop wager and a flop wager.

It should be also clearly understood that, although the steps of the poker game method are described in a particular sequence, it is within the spirit and scope of the present invention that the steps may be performed in other sequences. Only the sequence of exposing player and community cards, and of determining winning hands prior to paying wagers, and of determining losing hands prior to collecting wagers, are material.

For example, although the sequence of exposing the cards is material, the sequence that the cards are dealt is immaterial. Although it is preferred that each card is dealt from a deck or shoe as it is exposed, as described above, it is within the spirit and scope of the present method that all player cards and community cards may be dealt in any manner desired, so long as each card is dealt prior to or concurrently with being exposed.

As an example, all player and community cards may be first dealt face down, and then each exposed in accordance with the steps of the present method (first the player's cards, then three community cards, next a fourth community card, and finally a fifth community card). As another example, all player cards may be first dealt and exposed, and then all community cards dealt, followed by exposing three community cards, then a fourth, and finally exposing a fifth community card.

Casino game security concerns may also influence the order of steps of the present poker game method without departing from the spirit and scope of the present invention. For example, casinos generally prefer to collect losing wagers immediately to reduce the likelihood that a player may cheat by removing or reducing the losing wager. Therefore, it may be preferred that all prior wagers provided by a disqualified player are collected concurrently with the player being disqualified. As another example, rather than paying all winning wagers after the fifth community card is exposed, followed by collecting all losing wagers, a dealer may instead resolve each player's wagers sequentially, either collecting one player's losing wagers or paying his winning wagers, before resolving a next player's wagers.

Figure 2:
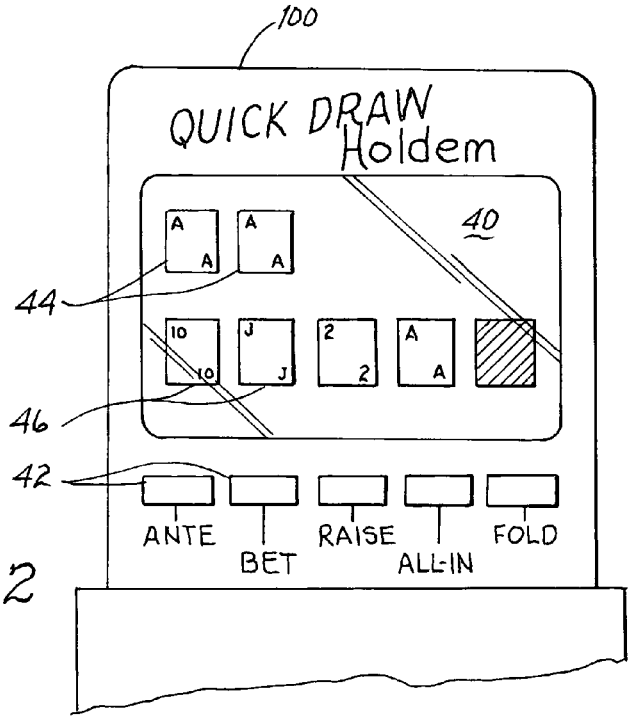
FIG. 2 is a front view of a video poker gaming machine displaying two player cards and five community cards and having game controls in accordance with an embodiment of the present invention.
Figure 3:
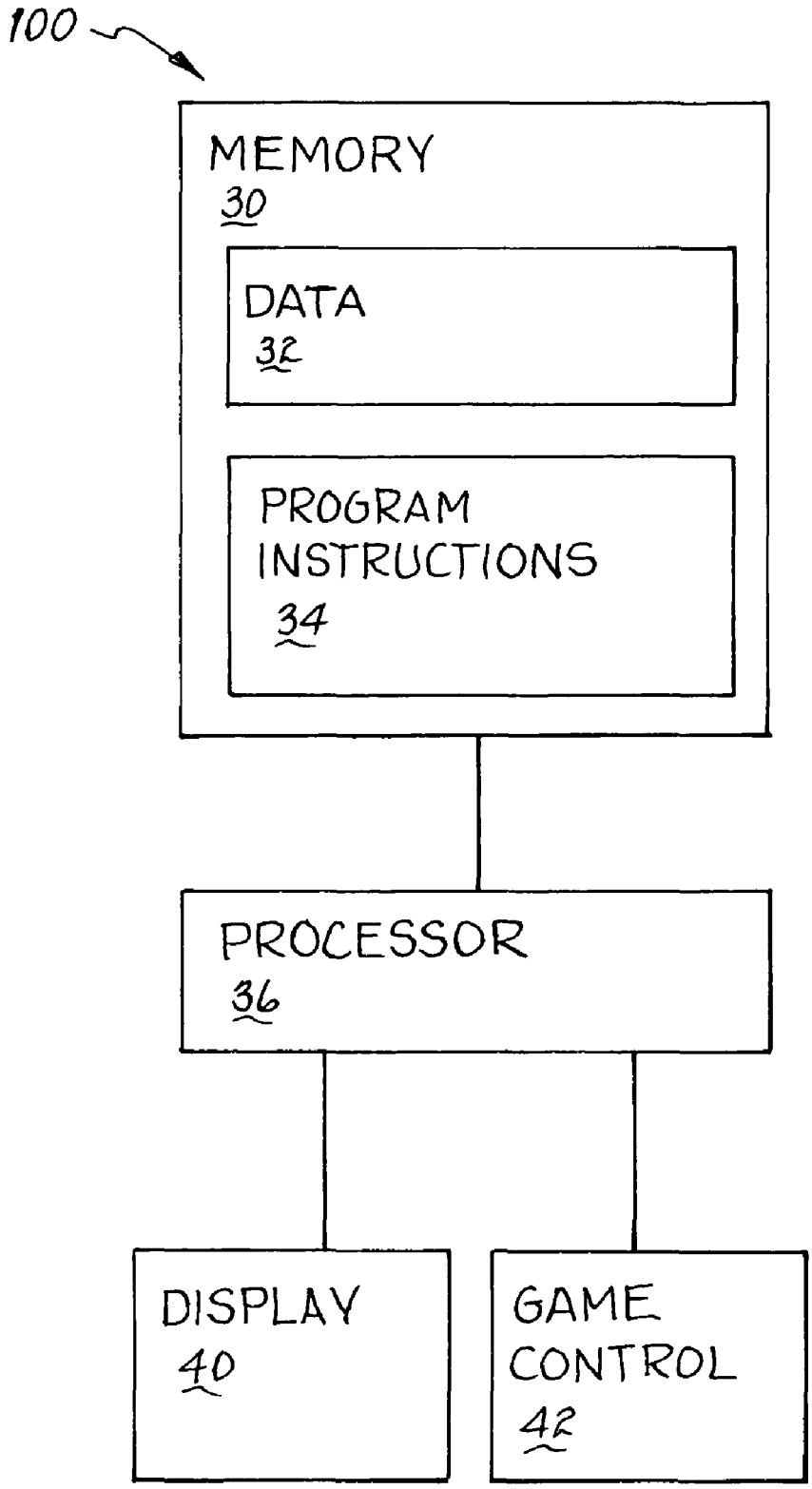
FIG. 3 is a block diagram of components of a system for providing a poker game in accordance with embodiments of the present invention and in which embodiments of the present invention may be practiced.

Turning now to FIG. 3, a system 100 for providing a poker game is depicted. A memory 30 stores data 32 and program instructions 34. A processor 36 is coupled to memory 30 for processing program instructions 34. A display 40 is coupled to processor 36 for displaying information to a player, and a game control 42 coupled to processor 36 receives an input from a player. Preferably, system 100 is a video poker machine such as depicted in FIG. 2, and game control 42 is a button or touchscreen overlay on display 40, or any other type of control well known in the art.

Program instructions 34 comprise instructions for providing a poker game in accordance with a method of the present invention. Specifically, program instructions 34 require a player to provide at least one wager, where the wager that is required is at least one of an ante wager, a pre-flop wager, a flop wager, and a turn wager. An input is received from game control 42 in response to the wager requirement. Any player not providing the required wager is disqualified from the poker game. Two cards 44 are displayed on display 40 to a player remaining in the poker game. Three community cards 46 are next displayed, followed by a fourth community card 46, and a fifth community card 46 on display 40 to a player remaining in the poker game.

Program instructions 34 determine for a player remaining in the poker game a highest value five-card combination of the two cards 44 dealt to the player and the five community cards 46. An amount is paid corresponding to the first wager for the player in conformity with the highest value five-card combination of the player being not less than a first predetermined value.

It should be clearly understood that system 100 may include program instructions 34 for executing a poker game in accordance with any or all of the methods embodied in the present invention. For example system 100 may include program instructions 34 for requiring one, two, three, or all four of the ante wager, pre-flop wager, flop wager, and turn wager. As another example, system 100 may include program instructions 34 requiring all wagers to be of equal amounts, or of predetermined amounts, or amounts within a specified range. As yet another example, system 100 may include program instructions 34 specifying that each player wager is awarded if the player's hand value meets or exceeds a single predetermined value, such as a pair of Kings, or a different predetermined value for any or all wagers.

Turning to FIG. 2, controls 42 are provided on a video poker machine. Each control 42 may have a designated function, such as bet, fold, cash out, change betting denominations, or the like. Alternatively, a function of each control 42 may vary according to the progress of the game.

Although it is preferred that system 100 be a video gaming machine as depicted in FIG. 2, it should be clearly understood that system 100 may instead be any general purpose computer or distributed system so long as it allows a player to participate in a poker game via display 40 and game control 42. Display 40 may be, for example, a television screen, computer monitor, PDA display, cellphone display, or the like; control 42 may be a key, button, pointing device, or the like; and processor 36 and memory 30 may be coupled to each other and to display 40 and control 42 either directly or through a network connection such as via the internet or a private network.

As depicted in FIG. 2, cards 44 and 46 that have been exposed to the player are displayed as resembling playing cards having a suit and value indicia. In accordance with an embodiment of the present invention, community cards 46 that have not yet been revealed may be depicted on display 40 by indicia resembling a playing card back design. A player may select via game controls 42 which of the community cards 46 (designated by playing card back indicia) to display next.

For example, a player may select for the flop three of the five community cards 46 depicted by playing card back indicia. In response, the playing card back indicia are replaced with suit and value indicia for the selected cards 46. Similarly, a player may select via game control 42 which of the remaining community cards 46 to reveal for the turn, resulting in the playing card back indicia being replaced with suit and value indicia for the selected community card 46. A player may thus feel involved in the outcome of the game beyond simply deciding whether to bet or fold.

In accordance with another embodiment, a player may discard and redraw cards prior to determining whether a wager is paid. The player may use game control 52 to select a player card 44 or community card 46 to discard. System 100 removes from display 40 the suit and value indicia associated with the discarded card and replaces it with suit and value indicia for a new card. The new card may be used in determining the value of the player's highest five-card combination. Although it is preferred that a player be allowed to discard and redraw no more than two cards, it is within the spirit and scope of the present invention that any number of discards and redraws be allowed to the player. Furthermore, certain benefits may be obtained by allowing discards only of the community cards 46, or only of the player cards 44, such as when several players are participating in the game and confusion would result if each player were allowed to discard and replace community cards 46 common to all players.

While the invention has been particularly shown and described with reference to the preferred embodiments thereof, it will be understood by those skilled in the art that the foregoing and other changes in form, and details may be made therein without departing from the spirit and scope of the invention.

What is claimed is:

1. A method of playing a poker game comprising, in combination, the steps of:

collecting from each at least one player an ante wager;

dealing two cards to each said player;

dealing three community cards;

exposing said three community cards to each said player remaining in said poker game;

requiring a flop wager from each said player remaining in said poker game;

disqualifying any said player failing to provide said flop wager;

dealing a fourth community card;

exposing said fourth community card to each said player remaining in said poker game;

requiring a turn wager from each said player remaining in said poker game;

disqualifying any said player failing to provide said turn wager;

dealing a fifth community card;

exposing said fifth community card to each said player remaining in said poker game;

collecting each of said ante wager, said flop wager, and said turn wager being placed by each said player disqualified from said poker game;

determining for each said player remaining in said poker game a highest value five-card combination of said two cards dealt to said player and said five community cards;

paying a first amount corresponding to said ante wager to each said player remaining in said poker game in conformity with said player having said highest value five-card combination being not less than a pre-determined value;

paying a second amount corresponding to said flop wager to each said player remaining in said poker game in conformity with said player having said highest value five-card combination being not less than said pre-determined value;

paying a third amount corresponding to said turn wager to each said player remaining in said poker game in conformity with a poker ranking of said highest value five-card combination of said player; and collecting each of said ante wager, said flop wager, and said turn wager being placed by each said player remaining said poker game in conformity with having said highest value five-card combination being less than said pre-determined value.

2. The method of claim 1, wherein an amount of each of said ante wager, said flop wager, and said turn wager is pre-determined.

3. The method of claim 1, wherein an amount of said ante wager, an amount of said flop wager, and an amount of said turn wager are equal.

4. The method of claim 1, wherein said first amount comprises an even-money payout amount, said second amount comprises an even money payout amount, and said third amount comprises a payout amount in conformity with a poker ranking of said highest value five-card combination for said player.

* * * * *